US007636957B2

(12) United States Patent
Funari

(10) Patent No.: US 7,636,957 B2
(45) Date of Patent: Dec. 29, 2009

(54) URINAL

(75) Inventor: Michael A. Funari, Apex, NC (US)

(73) Assignee: Zurn Industries, LLC, Erie, PA (US)

( * ) Notice: Subject to any disclaimer, the term of this patent is extended or adjusted under 35 U.S.C. 154(b) by 344 days.

(21) Appl. No.: 11/511,883

(22) Filed: Aug. 29, 2006

(65) Prior Publication Data

US 2007/0074337 A1 Apr. 5, 2007

Related U.S. Application Data

(60) Provisional application No. 60/712,588, filed on Aug. 30, 2005.

(51) Int. Cl.
*A47K 11/12* (2006.01)

(52) U.S. Cl. ..... 4/301; 4/144.1; 4/679

(58) Field of Classification Search ..... 4/144.1, 4/286, 288, 290, 292, 301, 309, 310, 462, 4/679

See application file for complete search history.

(56) References Cited

U.S. PATENT DOCUMENTS

| | | | | |
|---|---|---|---|---|
| 780,572 | A * | 1/1905 | Boosey | 137/216.1 |
| 818,164 | A * | 4/1906 | Hannagan | 137/247.33 |
| 1,411,125 | A | 3/1922 | O'Brien | |
| 1,507,531 | A | 9/1924 | Vaudell | |
| 2,095,024 | A * | 10/1937 | Boosey | 210/300 |
| 3,626,980 | A | 12/1971 | Svensson | |
| 4,244,061 | A | 1/1981 | Webster et al. | |
| 5,711,037 | A | 1/1998 | Reichardt et al. | |
| 6,053,197 | A | 4/2000 | Gorges | |
| 6,286,153 | B1 | 9/2001 | Keller | |
| 6,401,266 | B1 | 6/2002 | Mitchell et al. | |
| 6,425,411 | B1 | 7/2002 | Gorges | |
| 6,589,440 | B2 | 7/2003 | Atwill | |
| 6,644,339 | B2 | 11/2003 | Gorges et al. | |
| 6,701,541 | B2 | 3/2004 | Romagna et al. | |
| 2004/0163171 | A1 | 8/2004 | Hall | |
| 2004/0181861 | A1 | 9/2004 | Inglin et al. | |
| 2004/0211267 | A1 | 10/2004 | Higgins | |

FOREIGN PATENT DOCUMENTS

| | | | |
|---|---|---|---|
| EP | 0195189 | | 9/1986 |
| WO | WO 94/25693 | | 11/1994 |
| WO | WO 03/018922 | A1 | 3/2003 |
| WO | WO 2004/010835 | A1 | 2/2004 |
| WO | WO 2004/015211 | A1 | 2/2004 |

* cited by examiner

*Primary Examiner*—Huyen Le
(74) *Attorney, Agent, or Firm*—The Webb Law Firm

(57) ABSTRACT

An oil-based odor trap arrangement for a waterless urinal including (a) a bell trap tube received within a cavity situated in a lower portion of the waterless urinal, wherein one end of the tube is adapted to be removably attached to the cavity; and (b) a strainer having a body and defining a cap portion and an integrally attached ring portion extending axially away from the cap portion, wherein the strainer is adapted to be received onto an opposite end of the tube whereby the ring portion partially envelopes the tube thus forming a baffle configured to: 1) contain an oil-based substance between the ring portion and a wall of the cavity; 2) accommodate the flow of fluid from the urinal between the ring portion and the tube; and 3) direct the fluid into the tube.

19 Claims, 6 Drawing Sheets

URINAL

CROSS REFERENCE TO RELATED APPLICATION

This application claims the benefit of U.S. Provisional Application No. 60/712,588 entitled "Urinal," filed on Aug. 30, 2005, which is hereby incorporated by reference.

BACKGROUND OF THE INVENTION

1. Field of the Invention

The present invention relates generally to a waterless urinal and, more particularly, to a waterless urinal designed for improved maintenance thereof by providing a removable sealed odor trap and other features.

2. Description of Related Art

With increasing emphasis on water conservation, there is continuing interest in toilets and urinals designed to minimize the amount of water consumed in flushing and to mitigate excessive demands on both water supplies and wastewater disposal systems, both of which have tended to become overloaded with increasing populations.

Sanitation codes require urinals to provide an odor seal to contain gasses and odors which develop in the drain system; this function is conventionally performed by the well known P-trap or S-trap in which the seal is formed by a residual portion of the flushing water. This seal effectively provides a barrier to sewer odors from passing from the drainpipe beyond the trap. However, the upward-facing liquid surface communicates freely with the user environment and, therefore, the trap must be kept free of residual urine by copious flushing to prevent unacceptable odor levels from the liquid in the trap. As a result, a large amount of water is consumed in flushing these conventional urinals. Especially in the United States over many years when water was cheap and plentiful, conventional flushing type urinals and water-wasteful toilets held an unchallenged monopoly. However, more recently, threatened and real water shortages have aroused new environmental concerns and heightened conservation awareness as evidenced by the introduction of low flush toilets. As the cost of water increases and budgets tighten, the prospect of a viable waterless urinal system becomes extremely attractive to a wide range of public agencies, cities, states, penal institutions, defense establishments, recreational and parks departments and the like.

Waterless urinals utilizing oil-sealed odor traps have now become viable. Examples of existing waterless urinals utilizing oil-sealed odor traps are disclosed in International Publication No. WO 94/25693 and U.S. Pat. No. 5,711,037. These prior art waterless urinals include a bell trap embodied as a removable disposable cartridge. Use of the disposable cartridge provides a continual cost expenditure requirement during the lifetime of the waterless urinal. Additionally, it is necessary to maintain a readily available and accessible supply of cartridges to maintenance personnel who service the waterless urinal. Furthermore, proprietary cartridges may present shortage or unavailability issues in the future, which may lead to increased costs associated with the disposable cartridges. Consequently, parties responsible for servicing the waterless urinal may be required to maintain a continual inventory of the disposable cartridges, which may also contribute to increased costs.

Accordingly, there is a need to provide a waterless urinal utilizing an oil-sealed odor trap that does not rely on a disposable cartridge system. Specifically, such a waterless urinal would be conducive to improved maintenance thereof, lowered operating costs, and improved functionality over existing waterless urinals.

SUMMARY OF THE INVENTION

The present invention provides for an oil-based odor trap arrangement for a waterless urinal that includes (a) a bell trap tube having a first end and a second end received within a cavity situated in a lower portion of the waterless urinal, wherein the first end of the tube is adapted to be removably attached to the cavity; and (b) a strainer having a body and defining a cap portion and an integrally attached ring portion extending axially away from the cap portion, wherein the strainer is adapted to receive the tube such that the second end of the tube engages an underside of the cap portion whereby the ring portion partially envelopes the tube thus forming a baffle configured to: 1) contain an oil-based substance between the ring portion and a wall of the cavity; 2) accommodate the flow of fluid from the urinal between the ring portion and the tube; and 3) direct the fluid into the tube. The oil-based substance therefore functions as an odor trap for the waterless urinal.

DETAILED DESCRIPTION OF THE INVENTION

Figure 1A:
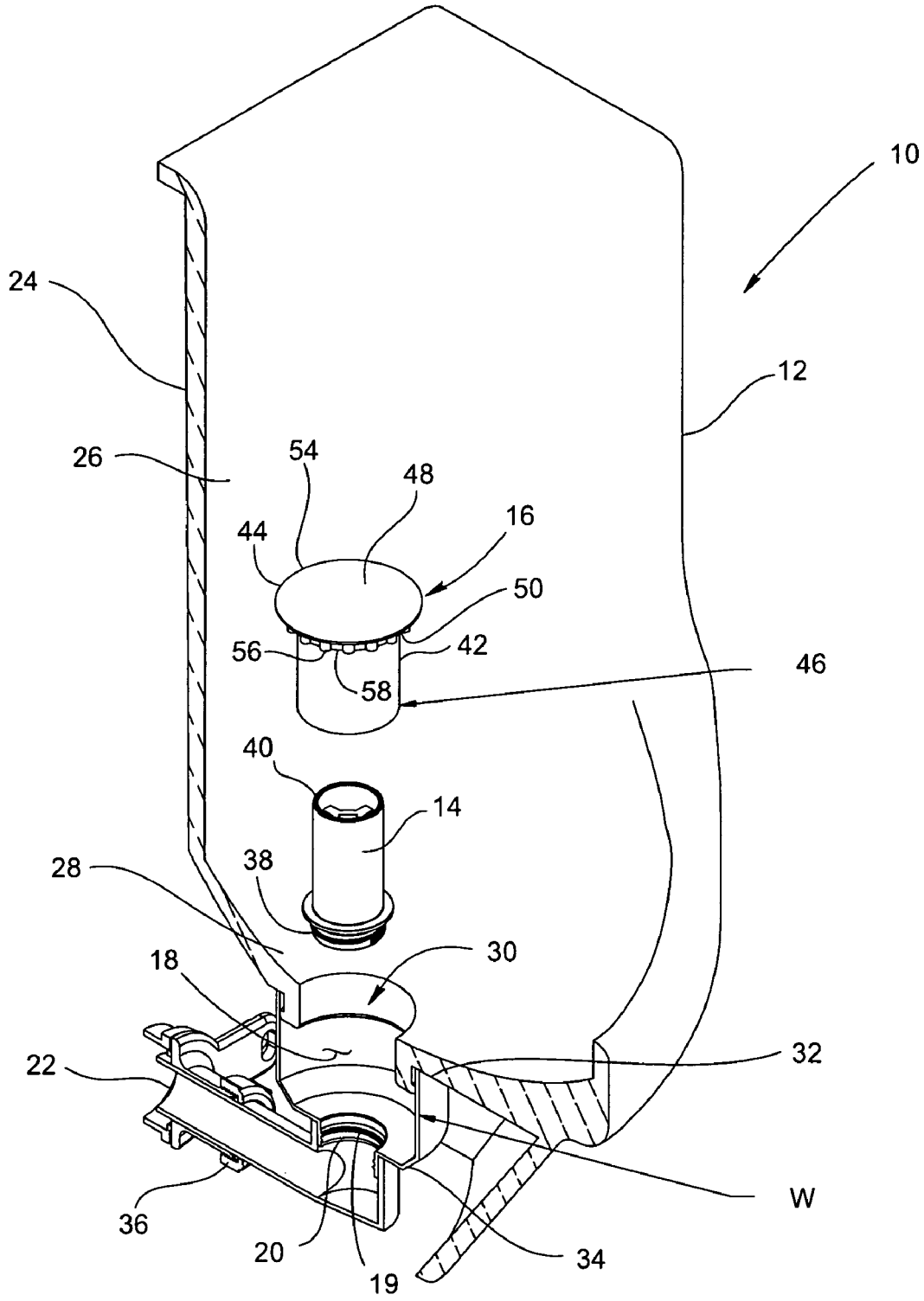
FIG. 1A is a cut-away exploded perspective view of the waterless urinal in accordance with the present invention.
Figure 1B:
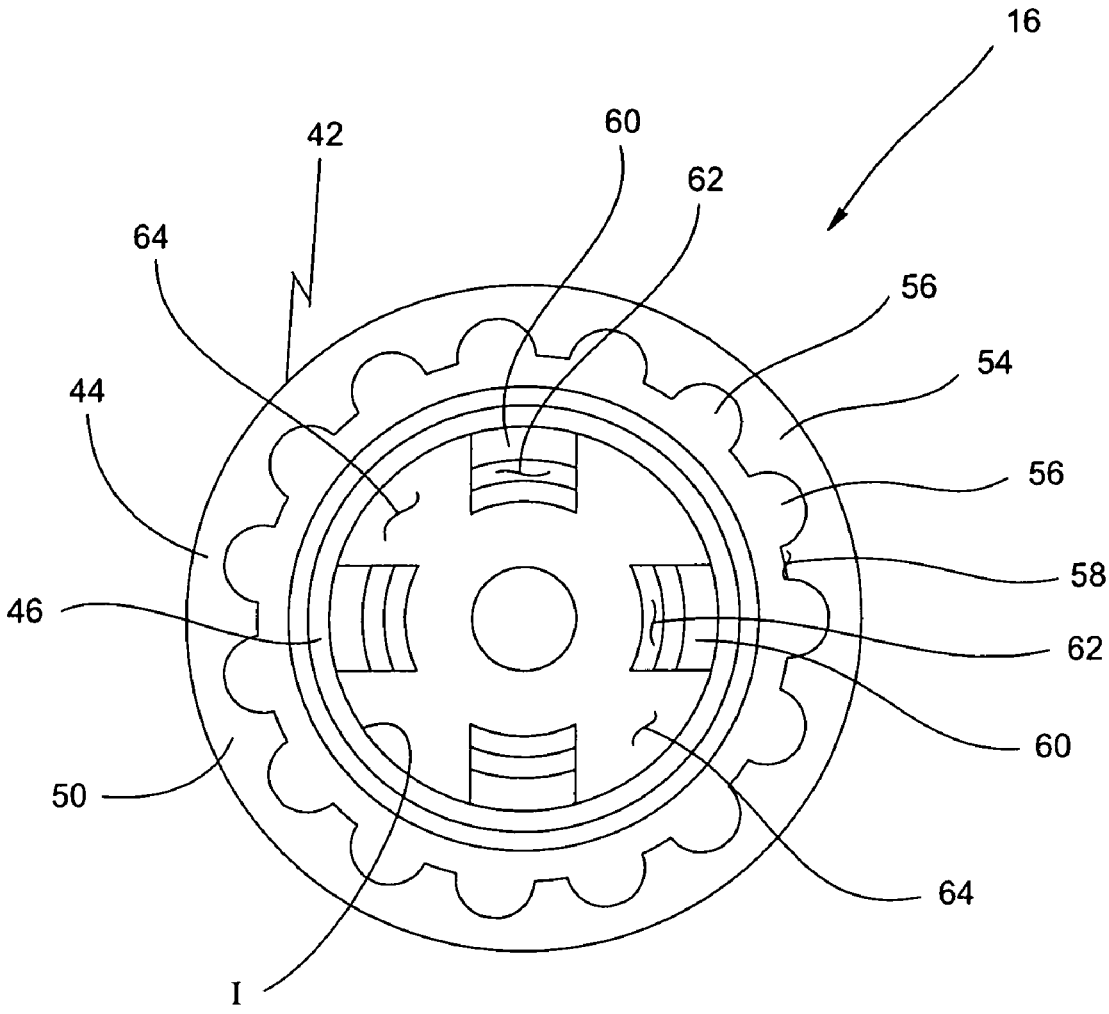
FIG. 1B is a bottom plan view of a strainer of the waterless urinal shown in FIG. 1A.
Figure 1C:
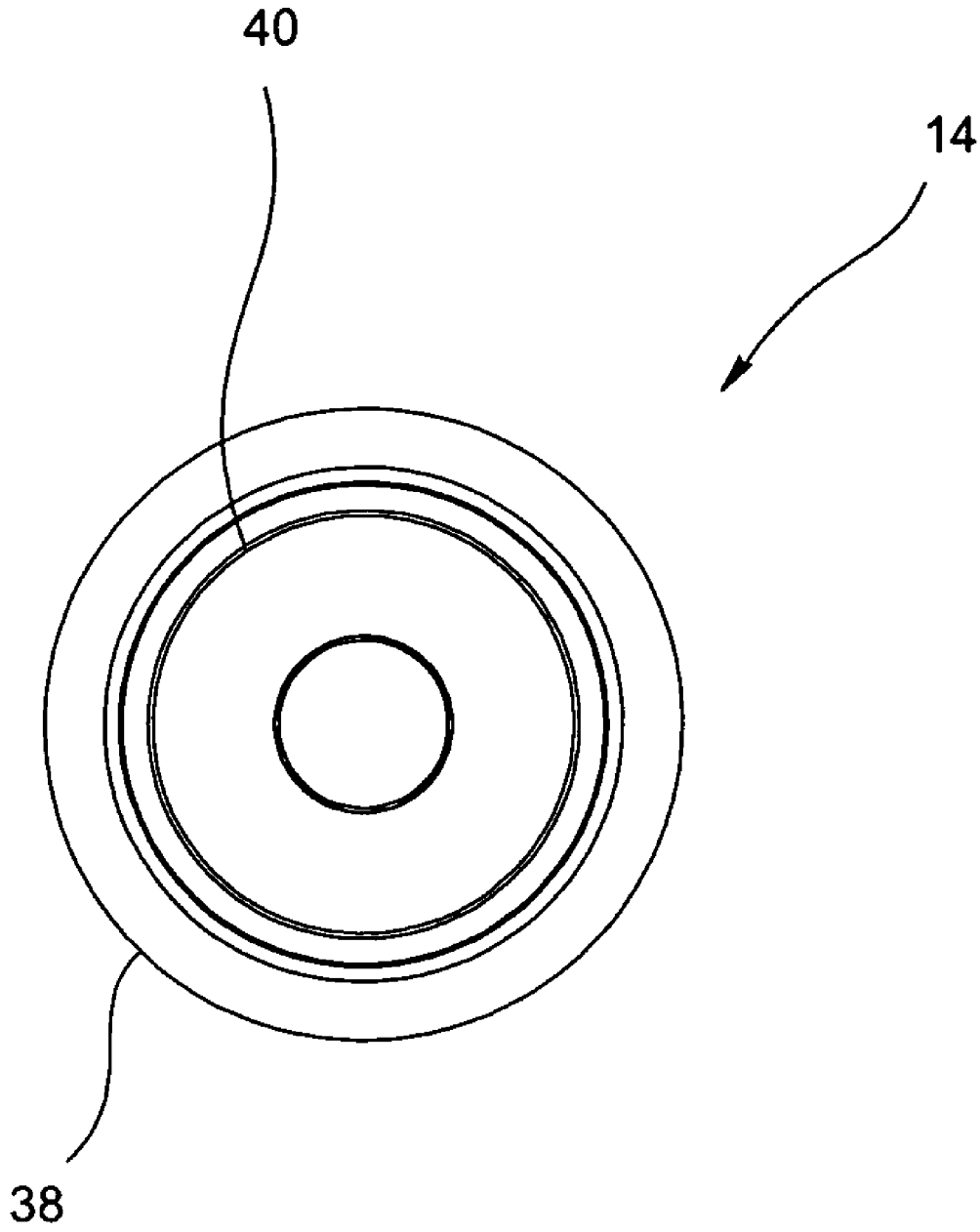
FIG. 1C is a top plan view of a bell trap tube of the waterless urinal shown in FIG. 1A.
Figure 2:
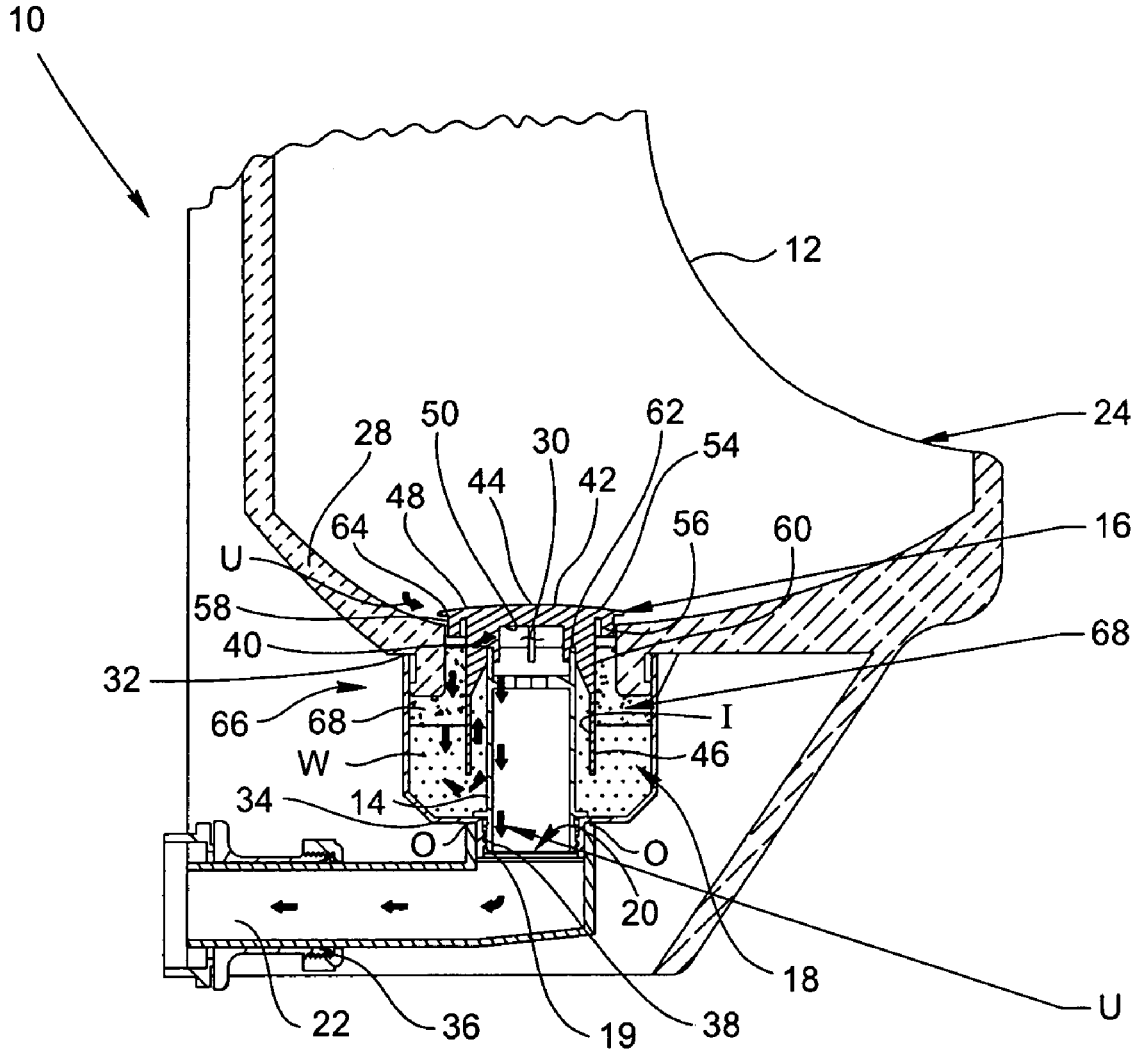
FIG. 2 is a cut-away side view of the waterless urinal of FIG. 1 illustrating the flow of urine therethrough.
Figure 3:
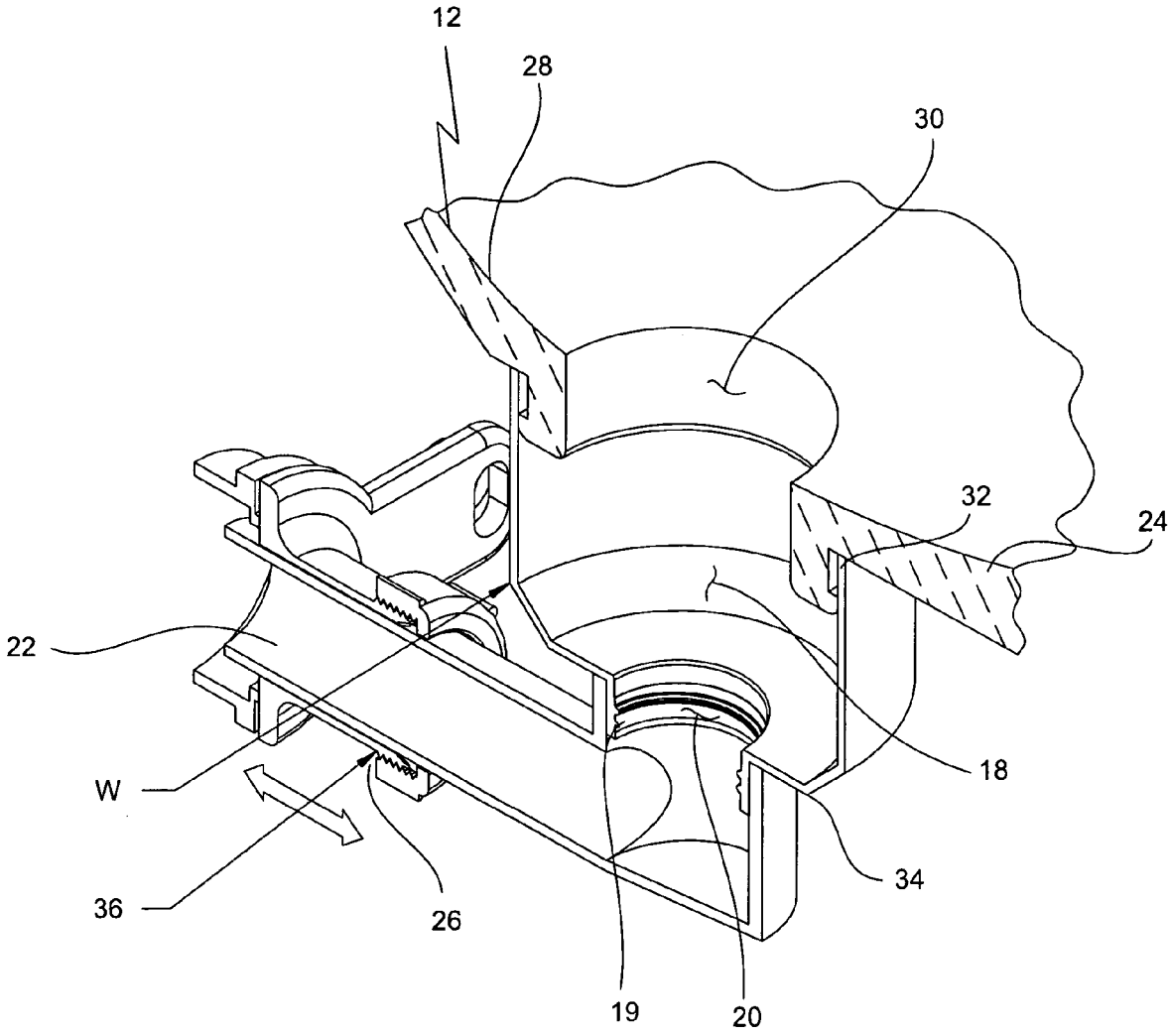
FIG. 3 is a partial exploded perspective view of an area for accommodating a bell trap tube and a strainer of the waterless urinal in accordance with the present invention.

A waterless urinal 10 according to a desired embodiment of the present invention is illustrated in FIGS. 1A, 2 and 3. As depicted in FIG. 1, the waterless urinal 10 includes a urinal mold 12, an elongated tube or bell trap tube 14, a strainer 16, a cavity or sealant/sediment chamber 18, a drain hole 20, and a drain pipe 22.

Figure 4:
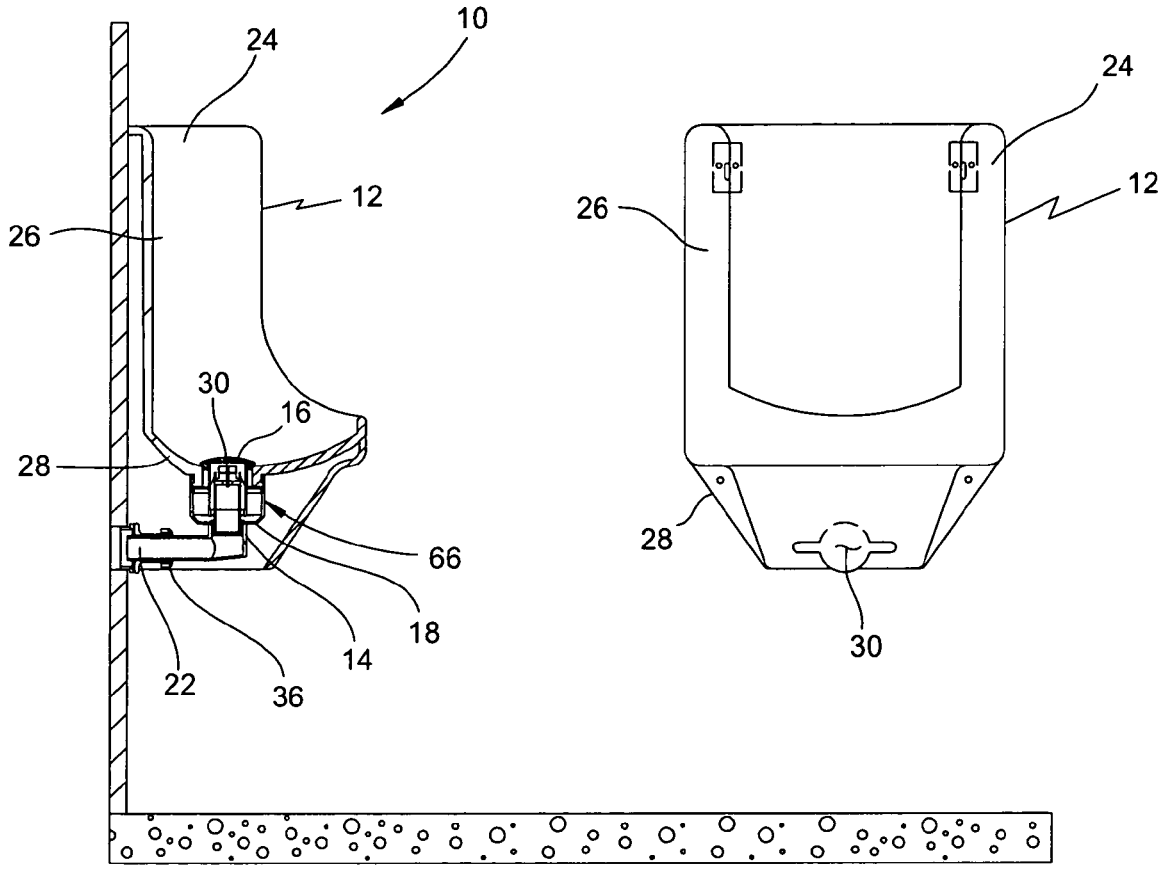
FIG. 4 is a cut-away side view and front view of the waterless urinal of FIG. 1 attached to a wall and supported above a floor to illustrate exemplary rough-in dimensions.

According to the desired embodiment, the urinal mold 12 is designed to fit against or into a designated wall and floor area, as shown in FIG. 4. Desirably, the urinal mold 12 is constructed of vitreous china, however, it is to be understood that any suitable material may be utilized including, but not limited to fiberglass. Referring to FIGS. 2 and 4, the urinal mold 12 includes a body 24 having an upper portion 26 and a lower portion 28, wherein an opening 30 is defined in the lower portion 28 of the urinal mold 12. Desirably, the lower portion 28 of the body 24 of the urinal mold 12 is designed to have a downward slope or inclination leading to the opening 30 to allow urine U and other fluids to flow toward and into the opening 30 due to the force of gravity. The opening 30 is sufficiently sized to accommodate the tube 14 and the strainer 16 therethrough.

Referring to FIGS. 1A, 2 and 3, the cavity or sealant/sediment chamber 18 defined by wall W includes a top end 32 and a bottom end 34, wherein the cavity or sealant/sediment chamber 18 may be integral with or attached to an underside of the lower portion 28 of the body 24 of the urinal mold 12. The opening 30 is fluidly connected to the top end 32 of the cavity or sealant/sediment chamber 18, and the drain hole 20 defined in the bottom end 34 thereof directs the urine U and other liquid passing therethrough into the drain pipe 22 fluidly connected thereto. Desirably, the cavity or sealant/sediment chamber 18 defines a threaded portion 19 defined at the bottom end 34 around the drain hole 20. In the desired embodiment, the drain pipe 22 extends in a horizontal orientation away from the urinal mold 12 to mate with appropriate drainline and plumbing connections (not shown) for disposal of the urine U or other liquids introduced into the waterless urinal 10. As shown in FIG. 3, an adjustable flanged connection 36 may be utilized to provide the requisite length necessary to reach downstream plumbing connections or to accommodate for missed rough-ins.

Referring to FIGS. 1A, 1C and 2, the tube 14 having a first end 38 and a second end 40 is received within the cavity or sealant/sediment chamber 18 situated in the lower portion 28 of the urinal mold 12. The first end 38 may be threaded for threadably attaching the tube 14 to the threaded portion 19 of the cavity or sealant/sediment chamber 18 such that the tube 14 is secured and provides a water tight seal within the drain hole 20 of the cavity or sealant/sediment chamber 18. The second end 40 of the tube 14 is adapted to receive the strainer 16 thereon. The second end 40 defines the sealant elevation and volume.

Referring to FIGS. 1A, 1B and 2, the strainer 16 includes a body 42 having a cap portion 44 and an integrated ring portion 46 axially extending from an underside thereof. Desirably, the cap portion 44 is shaped to cover the opening 30 (e.g., such as disc shape) and includes a top surface 48 and a bottom surface 50 when situated in a vertical position. The top surface 48 is a symmetric relatively planar surface that may include a slight curvature or arcuate shaped profile so as to divert urine U or any other liquids from the top surface 48 of the cap portion 44 into the opening 30 of the urinal mold 12. The cap portion 44 extends beyond a periphery of the ring portion 46 thus forming a lip 54. The lip 54 prevents evaporation of the sealant. The lip 54 may include a plurality of interspaced or spaced apart protrusions 56 extending axially away from the bottom surface 50 of the cap portion 44. The protrusions 56 may be integrally attached to the cap portion 44. Passageways 58 are defined between adjacent protrusions 56 to allow fluid, such as urine, to pass therethrough. A common problem with prior art waterless urinals is that excess water, such as water remaining from mopping activities, is poured into a drain of a urinal, which then causes sealant to be washed away. Such passageways 58 are sized to limit the volume of water allowed to pass through and into the cavity or sealant/sediment chamber 18. For example, ten spaced apart protrusions 56 around the lip 54 of the cap portion 44 may be spaced such that the respective passageways 58 are approximately 0.8 square inches, wherein the volume of water flowing into the cavity or sealant/sediment chamber 18 is less than 5 gallons per minute. Water flow within this range prevents the sealant from being washed down the drain hole 20.

Referring to FIGS. 1B and 2, the cap portion 44 further includes a plurality of spaced-apart ribs 60, for example, four ribs 60 spaced evenly apart around the circumference of the tube 14, extending axially away from the bottom surface 50, wherein each rib 60 defines a groove 62 therein adapted to receive the second end 40 of the tube 14 thus securing the strainer 16 to the tube 14. The strainer 16 may also be secured to the tube 14 via various types of connections including, but not limited to friction fit, snap fit, or threadable connections. The ribs 60 may be integrally attached to the bottom surface 50 of the cap portion 44 and to a portion of an inner surface I of the ring portion 46. Openings 64 are defined between adjacent ribs 60 for allowing fluid to pass through to the tube 14. Such openings 64 are sized to limit the volume of water allowed to pass through the cavity or sealant/sediment chamber 18 and into the tube 14. For example, four spaced apart ribs 60 adjacent the tube 14 may be wide enough such that the respective openings 64 are approximately 0.25 square inches, wherein the volume of water flowing into the tube 14 is also less than 5 gallons per minute. The openings 64 also limit the volume of water allowed to pass into the tube 14, thus preventing the sealant from washing down the drain hole 20. The openings 64 offer a second line of protection in the event the passageways 58 in the cap portion 44 fail to limit large volumes of water flow, such as due to worn out protrusions 56 or damage to the cap portion 44 of the strainer 16. The body 24 of the strainer 16 may be made of a unitary piece of polymeric material including, but not limited to fiberglass.

As shown in FIG. 2, an oil-based odor trap arrangement 66 includes the assembly of the aforementioned components. Specifically, the first end 38 of the tube 14 is threadably engaged with the threaded portion 19 of the cavity or sealant/sediment chamber 18 to provide a water tight seal, however, it is to be understood that other connections conducive to separation may be utilized to secure the tube 14 into the cavity or sealant/sediment chamber 18 including, but not limited to friction fit and snap fit connections. The tube 14 may be easily installed or removed through use of a socket wrench or other force imparting tool for regular maintenance and cleaning. An O-ring O or other suitable sealing member may be situated at the connection point between the tube 14 and the cavity or sealant/sediment chamber 18.

Referring to FIG. 2, the strainer 16 is seated on and secured to the second end 40 of the tube 14 via the grooves 62 such that the ring portion 46 of the body 42 of the strainer 16 partially envelopes a length of the tube 14. Specifically, the resultant oil-based odor trap arrangement 66 forms a baffle designed or configured to: 1) contain an oil-based sealant or oil-based substance 68 between the ring portion 46 and the wall W of the cavity or sealant/sediment chamber 18; 2) accommodate the flow of urine U between the ring portion 46 and the tube 14; and 3) direct the urine U into the tube 14. The oil-based sealant or substance 68, such as that sold by Zurn Industries under the trademark AquaGreen™, has a density less than water and/or urine, so that the oil-based substance 68 will float on top of the water and the urine U to create a barrier. Typically, such an oil-based substance 68 may be a mixture of environmentally safe/non-toxic vegetable oil, colorant, and a fragrance, e.g., perfume or other scent that is commonly known. The oil-based odor trap arrangement 66 is designed to accommodate the free flow of urine from the urinal mold 12 to the drain pipe 22. Specifically, the oil-based odor trap arrangement 66 functions as an odor trap to prevent the smell of urine and drain line gasses from backing up into a restroom in which the waterless urinal 10 is situated.

The arrows of FIG. 2 represent the flow of urine U through the oil-based odor trap arrangement 66. Referring to FIG. 2, urine U or other liquids are deposited on the urinal mold 12 and flow toward the strainer 16, through the passageways 58, and into the cavity or sealant/sediment chamber 18. The urine U passes through the oil-based substance 68 situated between the ring portion 46 and the wall W of the cavity or sealant/sediment chamber 18 because the density of urine U is greater than the oil-based substance 68. Thereafter, the urine U flows downwardly to the bottom end 34 of the cavity or sealant/sediment chamber 18 along the length of the ring portion 46.

The cavity or sealant/sediment chamber 18 may serve the functional purpose of a sediment chamber for collecting substances more dense than the oil-based substance 68 and more dense than the urine U. Upon reaching an end of the ring portion 46, the urine U moves upwardly between the inner surface I of the ring portion 46 and the tube 14. Thereafter, the urine U passes through the openings 64 in the bottom surface 50 of the cap portion 44 and spills into the tube 14, wherein the urine U is directed through the drain hole 20 and into the drain pipe 22. When large volumes of liquid, such as that deposited by cleaning personnel, are poured into prior art waterless urinals, the liquid causes the oil-based substance to be washed out of the prior art oil-based odor trap arrangement, thereby rendering the oil-based odor trap useless. By limiting the open area (i.e., passageways 58 via the inter-spaced protrusions 56 and the openings 64 via the spaced ribs 60) through the strainer 16, the flow rate of liquids that may pass through the strainer 16 and into the tube 14 is reduced, which therefore prevents a high flow rate when dumping large volumes of water into the waterless urinal 10.

Cleaning of the waterless urinal 10 and, more specifically the oil-based odor trap arrangement 66, is intended to be performed approximately twice a year. First, the strainer 16 is removed to allow access to the tube 14. Then, the tube 14 is detached from the cavity or sealant/sediment chamber 18 by unscrewing the tube 14 from the threaded portion 19 of the cavity or sealant/sediment chamber 18. Thereafter, warm water is poured into the cavity or sealant/sediment chamber 18 to flush any sediment collected therein and to rinse the drain pipe 22. Further, the area may be cleaned with a mild soap and water solution and/or disinfected with suitable cleaning agents. Then, the oil-based odor trap arrangement 66 is reassembled by threadably securing the tube 14 to the threaded portion 19 around the drain hole 20 and securing the strainer 16 to the tube 14. Finally, a new replacement oil-based substance 68 is introduced into the reassembled oil-based odor trap arrangement 66.

The waterless urinal 10 of the present invention is advantageous for many reasons. First, cleaning and maintenance of the odor trap arrangement 66 does not require replacement of a cartridge or the trap components. Further, specialized tools are not required in the cleaning and maintenance of the trap arrangement 66. The strainer 16 prevents large amounts of water from washing away the oil-based substance 68 and prevents or limits evaporation of the oil-based substance 68 from the trap arrangement 66. Furthermore, the strainer 16 and the trap arrangement 66 limit the turbulence within the flow of urine during typical use, thereby minimizing the loss of the oil-based substance 68 down the drain hole 20 and into the drain pipe 22.

The present invention has been described with reference to the preferred embodiments. Obvious modifications, combinations, and alterations will occur to others upon reading the preceding detailed description. It is intended that the invention be construed as including all such modifications, combinations, and alterations.

The invention claimed is:

1. An oil-based odor trap arrangement for a waterless urinal comprising:

an elongated tube having a first end and a second end, said tube received within a cavity situated in a lower portion of the waterless urinal, wherein said first end of said tube is adapted to be removably attached to the cavity; and a strainer having a body and defining a cap portion and a ring portion, said ring portion extending axially away from said cap portion, said cap portion having a top surface and a bottom surface extending beyond a periphery of said ring portion thereby forming a lip having a perimeter, said lip further comprising a plurality of spaced apart protrusions extending axially away from said bottom surface of said cap portion thus forming passageways between adjacent protrusions to allow fluid to pass therethrough, wherein said perimeter of said lip extends beyond a periphery of said protrusions, and wherein said strainer is adapted to receive said tube such that said second end of said tube engages an underside of said cap portion whereby said ring portion partially envelopes said tube thus forming a baffle configured to:

contain an oil-based substance between said ring portion and a wall of the cavity;

accommodate the flow of fluid from the urinal between said ring portion and said tube; and direct the fluid into said tube.

2. The arrangement as claimed in claim 1, wherein the cavity comprises a threaded portion for threadably attaching said first end of said tube to the cavity.

3. The arrangement as claimed in claim 1, wherein said strainer further comprises at least two spaced-apart ribs extending axially away from said bottom surface of said cap portion, said second end of said tube adapted to engage said ribs, wherein openings are defined between said spaced ribs for allowing fluid to pass through to said tube.

4. The arrangement as claimed in claim 3, wherein a groove is defined in each rib, said groove adapted to receive said second end of said tube such that said strainer is secured to said tube.

5. The arrangement as claimed in claim 3, wherein said cap portion comprises a plurality of spaced-apart ribs, wherein openings are defined between adjacent ribs for allowing fluid to pass through to said tube.

6. The arrangement as claimed in claim 3, wherein said ribs are integrally attached to said cap portion and a portion of an inner surface of said ring portion.

7. The arrangement as claimed in claim 1, wherein the cap portion is integrally attached to said ring portion of said body of said strainer.

8. The arrangement as claimed in claim 1, wherein said strainer is made of a unitary piece of polymeric material.

9. The arrangement as claimed in claim 1, wherein said tube and said strainer comprise of a polymeric material.

10. The arrangement as claimed in claim 1, wherein the cavity is integrally attached to said lower portion of the urinal.

11. The arrangement as claimed in claim 1, wherein said cap portion of said body of said strainer comprises an acruate shaped profile.

12. The arrangement as claimed in claim 1, wherein said oil-based substance comprises vegetable oil, colorant, fragrance and mixtures thereof.

13. The arrangement as claimed in claim 1, wherein said top surface of said cap portion is disc-shaped and has a constant diameter around said perimeter.

14. An oil-based odor trap arrangement in combination with a waterless urinal, the urinal comprises a body having an upper portion and a lower portion and defining a cavity situated in the lower portion thereof, wherein the lower portion defines an opening therein for allowing fluid to pass through the cavity and into a drain, the odor trap arrangement comprising:

an elongated tube having a first end and a second end received within the cavity, the opening in fluid communication with the tube, wherein said first end of said tube is removably attached to the cavity; and a strainer having a body and defining a cap portion and a ring portion, said ring portion extending axially away from said cap portion, said cap portion having a top surface and a bottom surface extending beyond a periphery of said ring portion thereby forming a lip having a perimeter, said lip further comprising a plurality of spaced apart protrusions extending axially away from said bottom surface of said cap portion thus forming passageways between adjacent protrusions to allow fluid to pass therethrough, wherein said perimeter of said lip extends beyond a periphery of said protrusions, and wherein said strainer is adapted to receive said tube such that said second end of said tube engages an underside of said cap portion whereby said ring portion partially envelopes said tube thus forming a baffle configured to:

contain an oil-based substance between said ring portion and a wall of the cavity;

accommodate the flow of fluid from the urinal between said ring portion and said tube; and direct the fluid into said tube.

15. The trap arrangement in combination with the waterless urinal as claimed in claim 14, wherein the cavity comprises a threaded portion for threadably attaching said first end of said tube to the cavity.

16. The trap arrangement in combination with the waterless urinal as claimed in claim 14, wherein said oil-based substance comprises vegetable oil, colorant, fragrance and mixtures thereof.

17. A method of cleaning an oil-based odor trap arrangement for a waterless urinal, the method comprising the steps of:

a) providing a waterless urinal having an oil-based odor trap arrangement attached thereto, the arrangement comprising an elongated tube having a first end and a second end, the tube received within a cavity situated in a lower portion of the waterless urinal, wherein the first end of the tube is removably attached to the cavity, and a strainer having a body and defining a cap portion and a ring portion, the ring portion extending axially away from the cap portion, the cap portion having a top surface and a bottom surface extending beyond a periphery of the ring portion thereby forming a lip having a perimeter, the lip further comprising a plurality of spaced apart protrusions extending axially away from the bottom surface of the cap portion thus forming passageways between adjacent protrusions to allow fluid to pass therethrough, wherein said perimeter of said lip extends beyond a periphery of said protrusions, and wherein the strainer is adapted to receive the tube such that the second end of the tube engages an underside of the cap portion whereby the ring portion partially envelopes the tube thus forming a baffle configured to: 1) contain an oil-based substance between the ring portion and a wall of the cavity, 2) accommodate the flow of fluid from the urinal between the ring portion and the tube, and 3) direct the fluid into the tube;

b) removing the strainer from the tube;

c) detaching the tube from the cavity; and d) rinsing the cavity with fluid to flush any sediment collected therein.

18. The method as claimed in claim 17, wherein the first end of the tube is threadably attached to the cavity.

19. The method as claimed in claim 17, further comprising the step of reattaching the tube to the cavity after rinsing of the cavity.

* * * * *